US007574972B1

(12) United States Patent
Fairchild

(10) Patent No.: US 7,574,972 B1
(45) Date of Patent: Aug. 18, 2009

(54) THREE-DIMENSIONAL SAIL APPARATUS

(76) Inventor: Gordon Fairchild, 81 Windwood La., Bristol, RI (US) 02809

( * ) Notice: Subject to any disclaimer, the term of this patent is extended or adjusted under 35 U.S.C. 154(b) by 20 days.

(21) Appl. No.: 11/786,382

(22) Filed: Apr. 10, 2007

(51) Int. Cl.
*B63H 9/04* (2006.01)

(52) U.S. Cl. ..... 114/102.22; 114/102.24; 114/102.25; 114/102.26; 114/102.29; 114/102.33

(58) Field of Classification Search ..... 114/102.22, 114/102.24, 102.25, 102.26, 102.29, 102.33; 244/153 R
See application file for complete search history.

(56) References Cited

U.S. PATENT DOCUMENTS 4,336,915 A * 6/1982 Stoecklin et al. ..... 244/153 R
4,624,203 A * 11/1986 Ferguson ..... 114/102.26
5,271,349 A * 12/1993 Magrini ..... 114/102.23
7,114,456 B2 10/2006 Sohy

* cited by examiner

*Primary Examiner*—Lars A Olson
*Assistant Examiner*—Daniel V Venne
(74) *Attorney, Agent, or Firm*—Salter & Michaelson

(57) ABSTRACT

A three-dimensional sail apparatus that is made up of a plurality of spacedly disposed foils and a sail cloth for attachment to the foils on opposite sides thereof. Each foil has opposed sail cloth supporting sides that together define a foil shape, A support is disposed between the sides for controlling the relative positioning between the sides of the foil, with each rail adapted to deflect under wind force against its related sail cloth so that the foil can assume opposite respective asymmetric foil shapes.

16 Claims, 8 Drawing Sheets

THREE-DIMENSIONAL SAIL APPARATUS

FIELD OF THE INVENTION

The present invention relates in general to a three-dimensional sail apparatus that employs airfoils for use on wind powered craft. More particularly, the present invention relates to an improved reversible airfoil that is used to support a sail fabric or sail cloth.

BACKGROUND OF THE INVENTION

In sailing terms the relative motion of a wind powered craft with regards to the wind direction may be referred to as sailing upwind, or sailing downwind. One sails downwind by positioning the sail to create as much drag as possible. This provides a wind pressure on the sail that pushes the craft along in the direction of the wind. For sailing downwind the sail configuration is not that critical. However, when sailing upwind or into the wind, the sail shape is more important. In order to sail upwind, the sails are positioned to generate aerodynamic lift in relation to the apparent wind. It is this lift that is translated into the driving force that propels the craft forward. When sailing upwind, drag is no longer beneficial, as it counteracts the resulting drive force. Therefore, it is important to developing sails that maximize lift while minimizing drag for sailing into the wind.

Three dimensional sails differ from conventional sails in that they have two surfaces of curvature rather than a single thin surface. These two surfaces create a pressure differential by forcing air to flow past them at different velocities, thus creating lift. As a result, high lift airfoils are asymmetrical and only generate lift efficiently in one direction. However, tacking in this manner is more difficult with a three dimensional sail due to its three dimensional fixed shape.

Accordingly, it is an object of the present invention to provide an improved three dimensional sail structure that is reversible as to its shape so as to facilitate lift in alternate directions.

Another object of the present invention is to provide a three dimensional sail apparatus that is reversible so as to assist in a "tacking" action.

SUMMARY OF THE INVENTION

To accomplish the foregoing and other objects, features and advantages of the present invention there is provided a three-dimensional sail apparatus that comprises a plurality of foils supported from a mast, a sail cloth for attachment to the foils on opposite sides thereof, and in which each of the foils includes a pair of rails that together form the foil shape, a plurality of spreaders that are spacedly disposed between the pair of rails, and a plurality of sliding connections that support the spreaders from the rails. The sliding connections enable the foil and attached sail cloth to reverse in direction from a first asymmetric shape to a reversed second complementary asymmetric shape.

Other aspects of the present invention include the sail cloth having spaced sleeves for attachment to each foil; an end one of the spreaders having a hole therein for receiving the mast; each spreader having opposite ends that are slideably supported from respective rails; each spreader having, in one embodiment thereof, a triangular shape and supported by one sliding connection to one of the rails and by two sliding connections to the other of the rails; each spreader including, in another embodiment thereof, a cross bar having a single attachment location to respective rails; each sliding connection includes a loop that connects from the spreader about the rail; the rail having a rectangular cross-section.

In accordance with another embodiment of the present invention there is provided a sail foil for supporting sail cloth and that comprises a pair of rails that together form the foil shape, a plurality of spreaders that are each disposed between the pair of rails with adjacent spreaders maintained in spaced relationship; and a plurality of sliding connections that support the spreaders from the rails with each spreader having at least one sliding connection coupled with each rail. The sliding connections enable the foil and attached sail cloth to reverse in direction from a first asymmetric shape to a reversed second complementary asymmetric shape.

Other aspects of the present invention include an end one of the spreaders having a hole therein for receiving the mast; each spreader having opposite ends that are slideably supported from respective rails; each spreader having a triangular shape and supported by one sliding connection to one of the rails and by two sliding connections to the other of the rails; each spreader including a cross bar having a single attachment location to respective rails; and each sliding connection including a loop that connects from the spreader about the rail.

In accordance with still another embodiment of the present invention there is provided a three-dimensional sail apparatus that is comprised of a plurality of spacedly disposed foils and a sail cloth for attachment to the foils on opposite sides thereof, with each foil having opposed sail cloth supporting sides that together define a foil shape, a support between the sides for controlling the relative positioning between the sides of the foil, and with each rail adapted to deflect under wind force against its related sail cloth so that the foil can assume opposite respective asymmetric foil shapes.

DESCRIPTION OF THE DRAWINGS

Numerous other objects, features and advantages of the present invention are described in conjunction with the accompanying drawings in which.

DETAILED DESCRIPTION

This invention constitutes a reversible three dimensional foil or wing capable of automatically transforming its asymmetry from one contour to the opposite merely by adjusting its boat's direction with respect to the wind. By bringing a boat about, the wind automatically transforms the foil, thus becoming capable of developing driving forces on its new tack. Such action is accomplished via the inclusion of reversible foil or wing sections (foil 20), which transpose their asymmetry under a lateral force to change in a horizontal plane. Sections are described as follows:

The leading edge (end 25) of the section consists of a leading edge spreader profiled in perimeter to effect the leading edge of the section. Centered within the spreader is a hole to allow the spreader to slide up and down the mast or forestay for jib wings. Affixed by cantilever attachment are two flexible rails extending in the aft direction, which constitute section sides. Additional spreaders are included subsequently providing appropriate rail spacing at chord line positions. Such spreaders are attached to the rails by sliding connections. Two versions of spreaders aft of the leading edge spreader are contemplated.

1.) A flat triangle arrangement having two sliding rail attachments at two corners with the third corner being attached to the opposite rail in the same manner.

2.) The other comprises a pipe teed at both ends. It has a sliding attachment on each rail.

Encompassing these sections is sail material (12) having sleeves (15) on the inner side to support the sections and house the rails. Intermittent gaps along the sleeve provide access openings for attaching the spreaders and retaining proper chord line positioning of the spreaders. For foils or wings acting in the position of the main sail, the lower extent is fastened to a boom. The upper extent is fastened to a gaff. They can then be drawn into span (operating position) by hoisting them up the mast with the main haliard. Similarly, foils fabricated as working jibs may or may not require either a gaff or boom, and would be raised into span by hoisting them up with the jib haliard.

The foils or wings automatically reverse in contour by adjusting the boat's direction to the wind (changing tack). They may be lowered by releasing the haliard for stacking or storing on the boom or in the close proximity of the hull. Storage is conveniently achieved on board the boat. Such storage may be configured to pose no aerodynamic influence during periods of inoperation. Boat operation only requires steering the rudder and adjusting the sheet (line connecting boom or lower foil end) to the boat. Storage of the wing or foil may be accomplished on board the boat, thus eliminating any need for removal or storage elsewhere.

Figure 1:
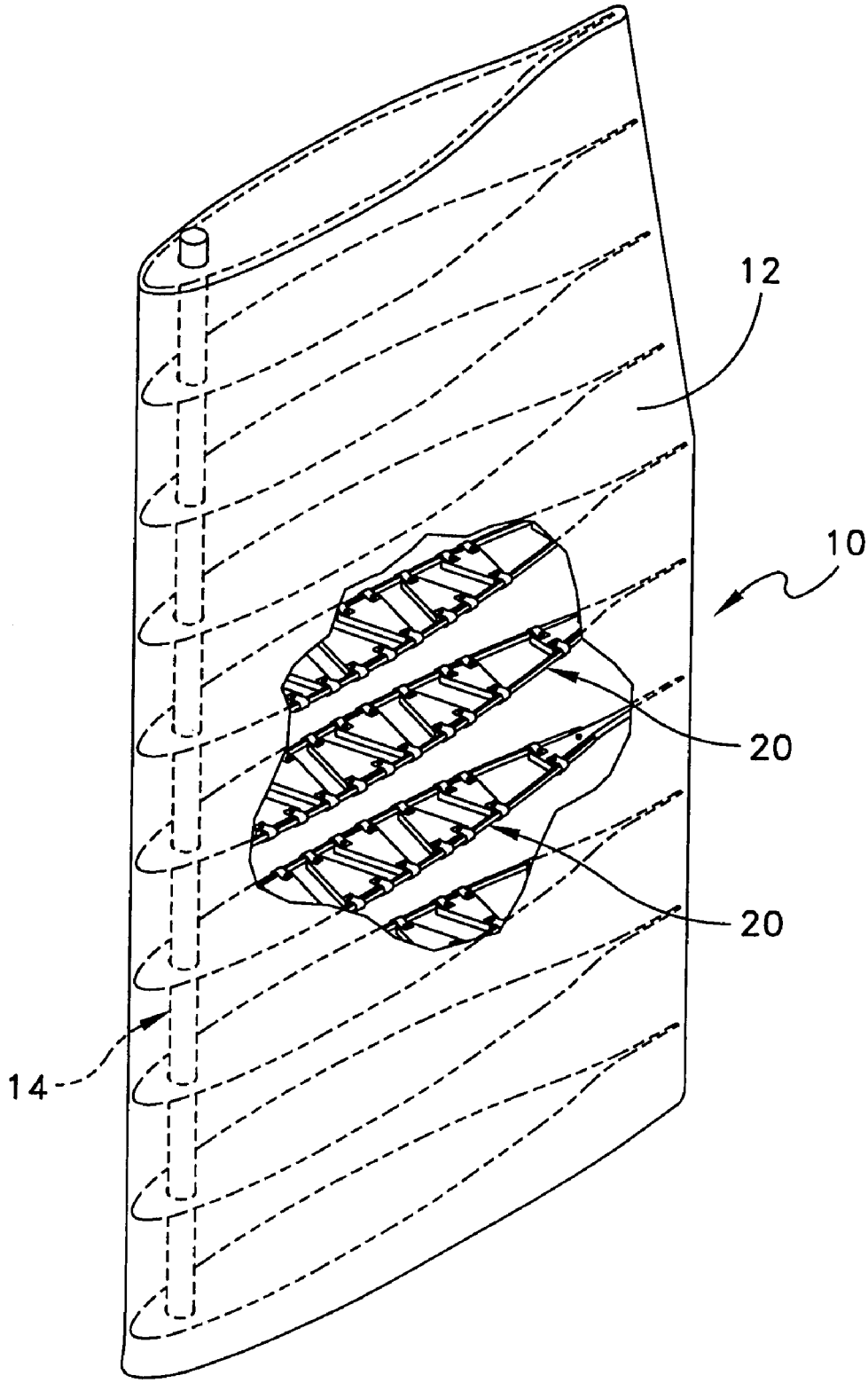
FIG. 1 is a schematic perspective view illustrating a sail apparatus embodying the principles of the present invention with multiple foils.
Figure 2:
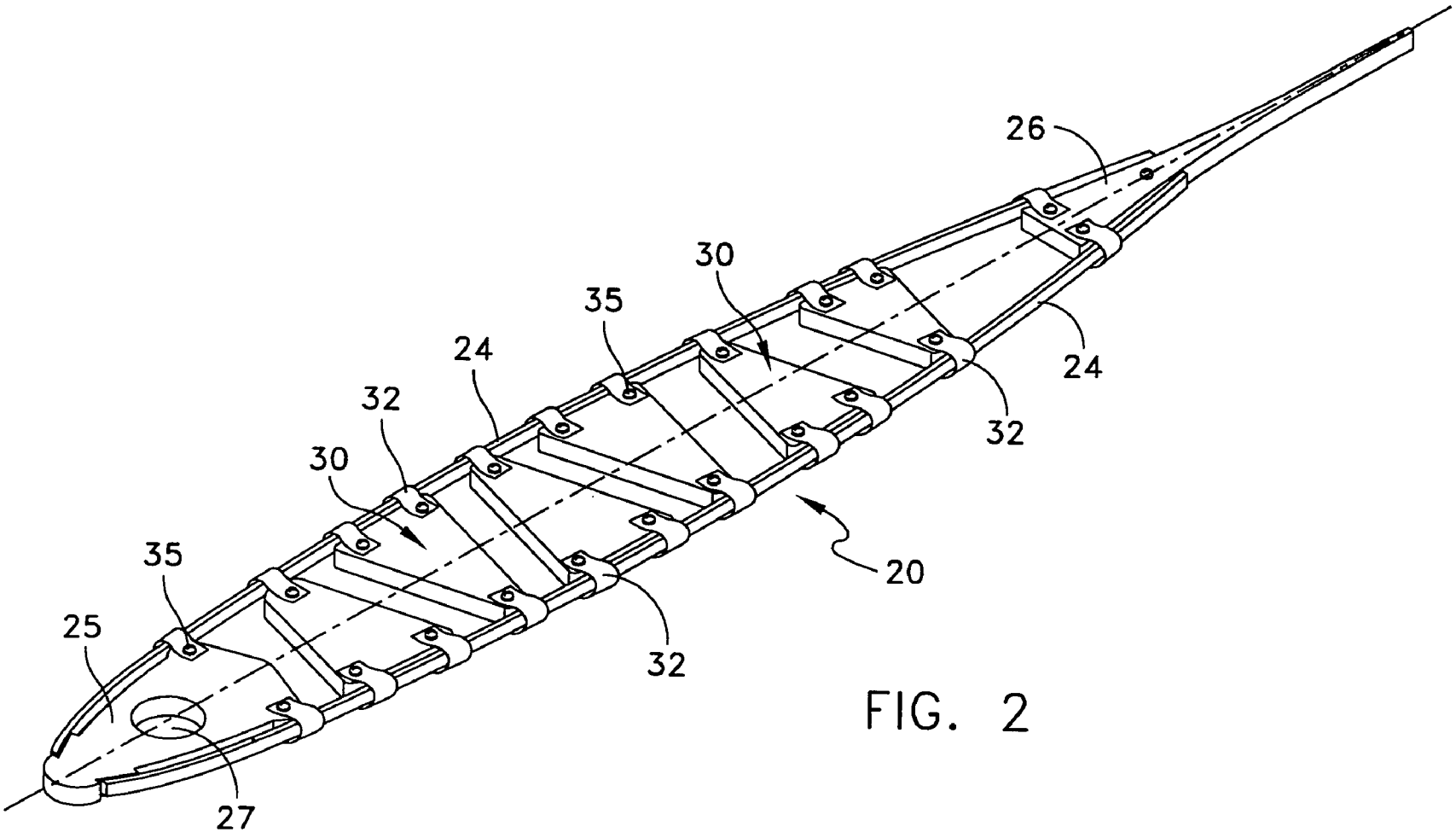
FIG. 2 is a perspective view of a single foil.

Reference is now made to the drawings and in particular FIG. 1 which is a schematic perspective view of a sail apparatus that embodies the principles of the present invention. This apparatus 10 includes a sail cloth 12 supported about a plurality of foils 20. FIG. 1 also shows, primarily in dotted outline, the mast 14 of the vessel that uses the sail apparatus 10. The three-dimensional sail apparatus of the present invention may be embodied in a number of different configurations corresponding to different types and constructions of sails.

Figure 6:
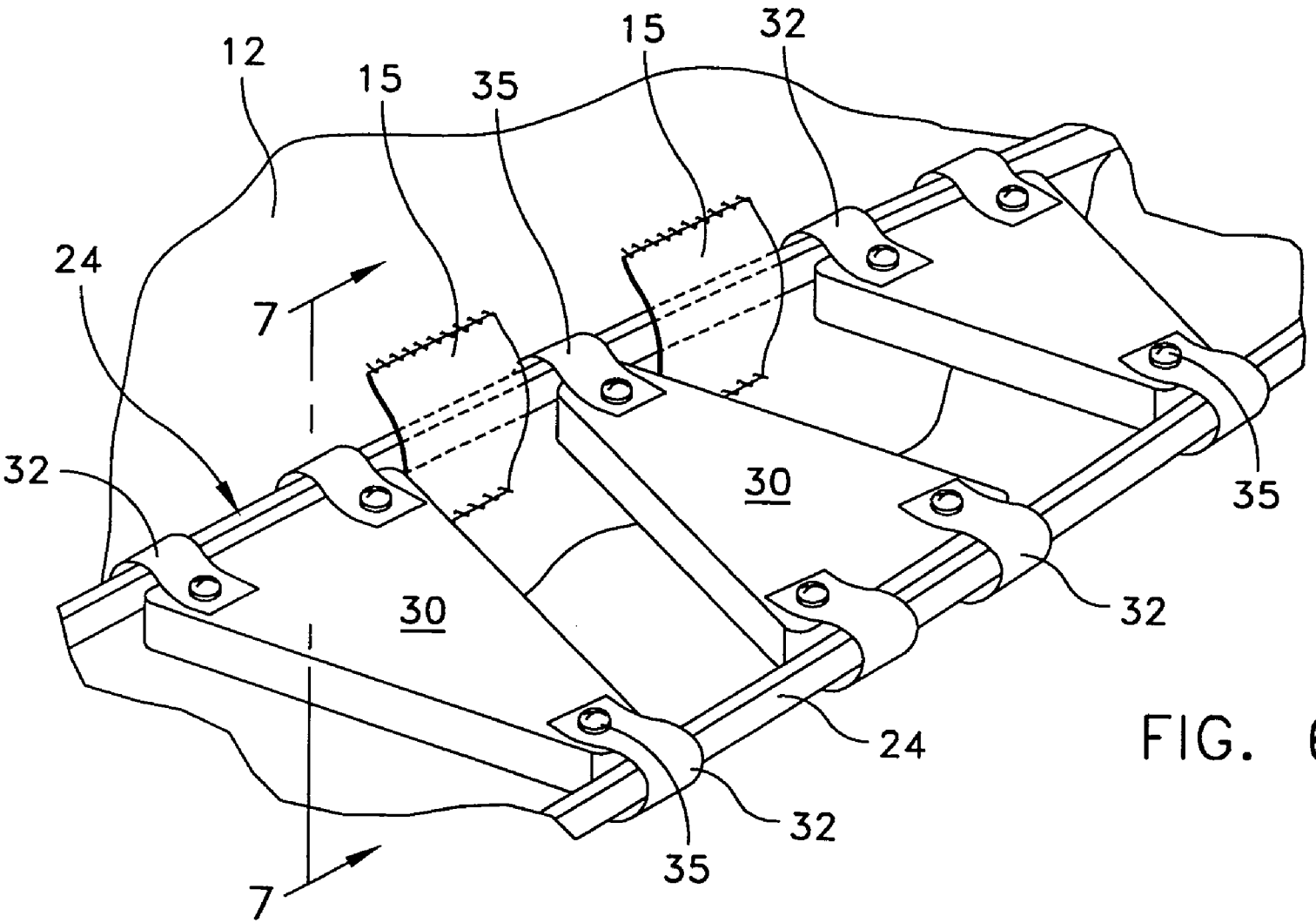
FIG. 6 is an enlarged fragmentary perspective view of the apparatus of FIG. 2.
Figure 7:
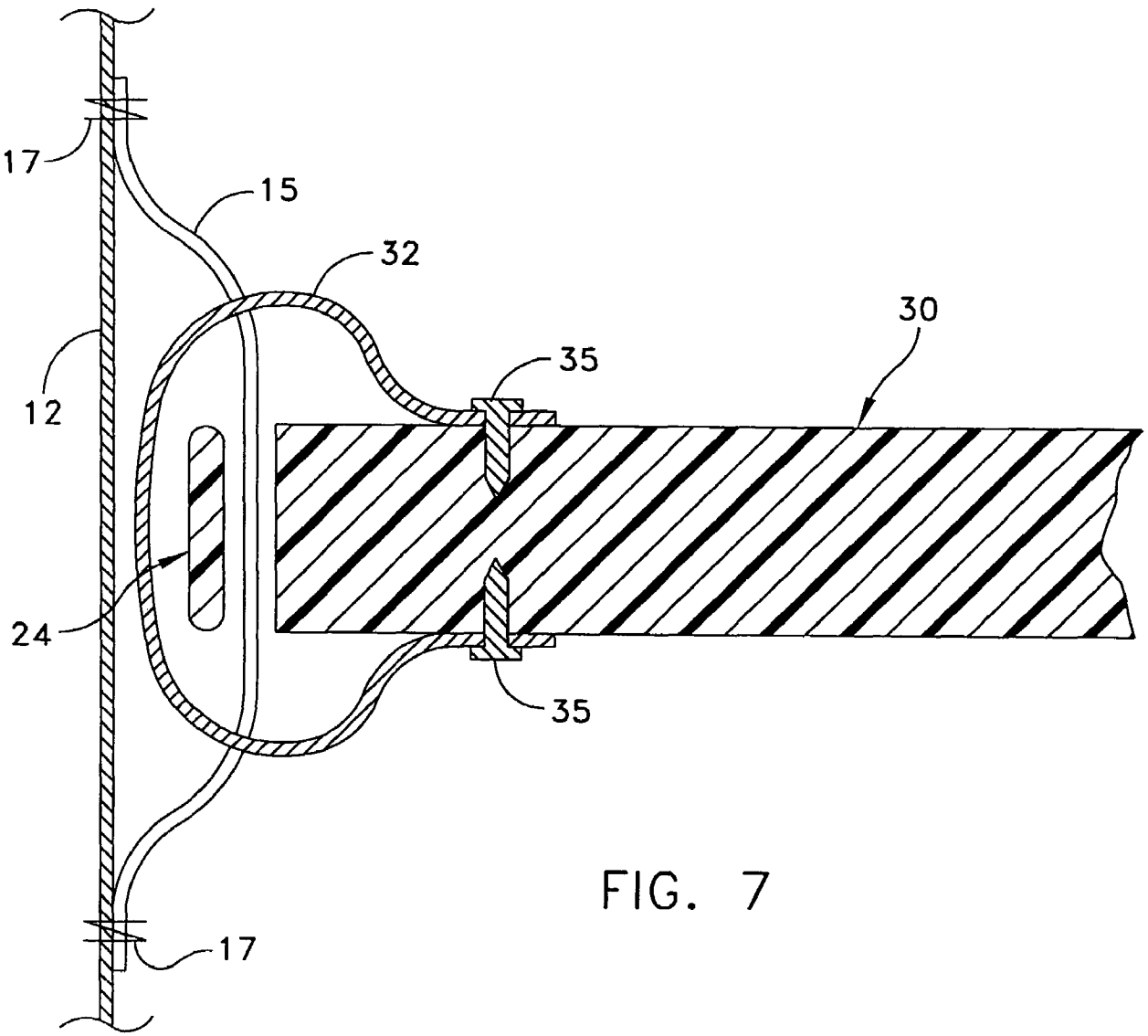
FIG. 7 is a cross-sectional view taken along line 7-7 of FIG. 6.
Figure 8:
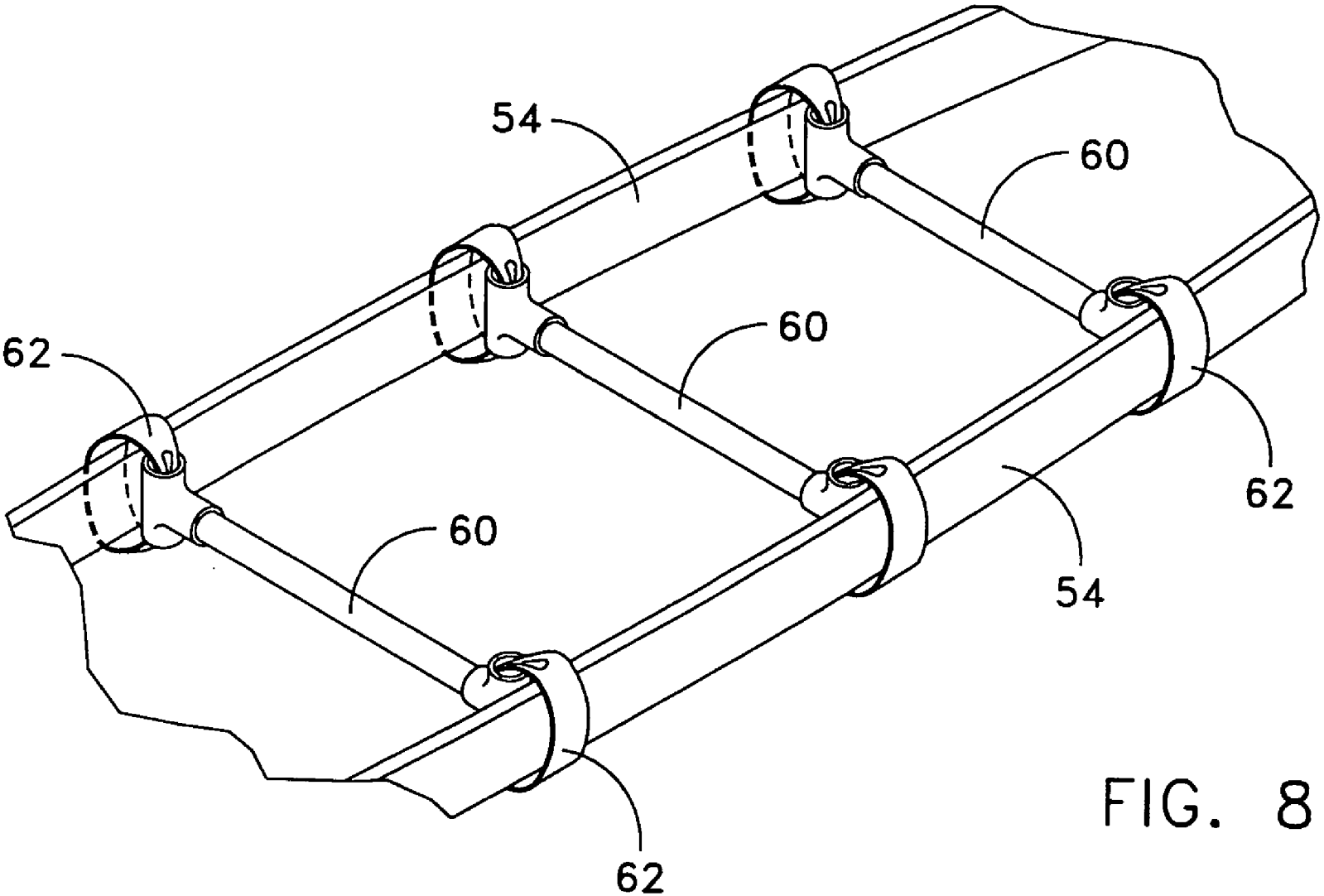
FIG. 8 is a fragmentary perspective view of an alternate embodiment of the sail apparatus.
Figure 9:
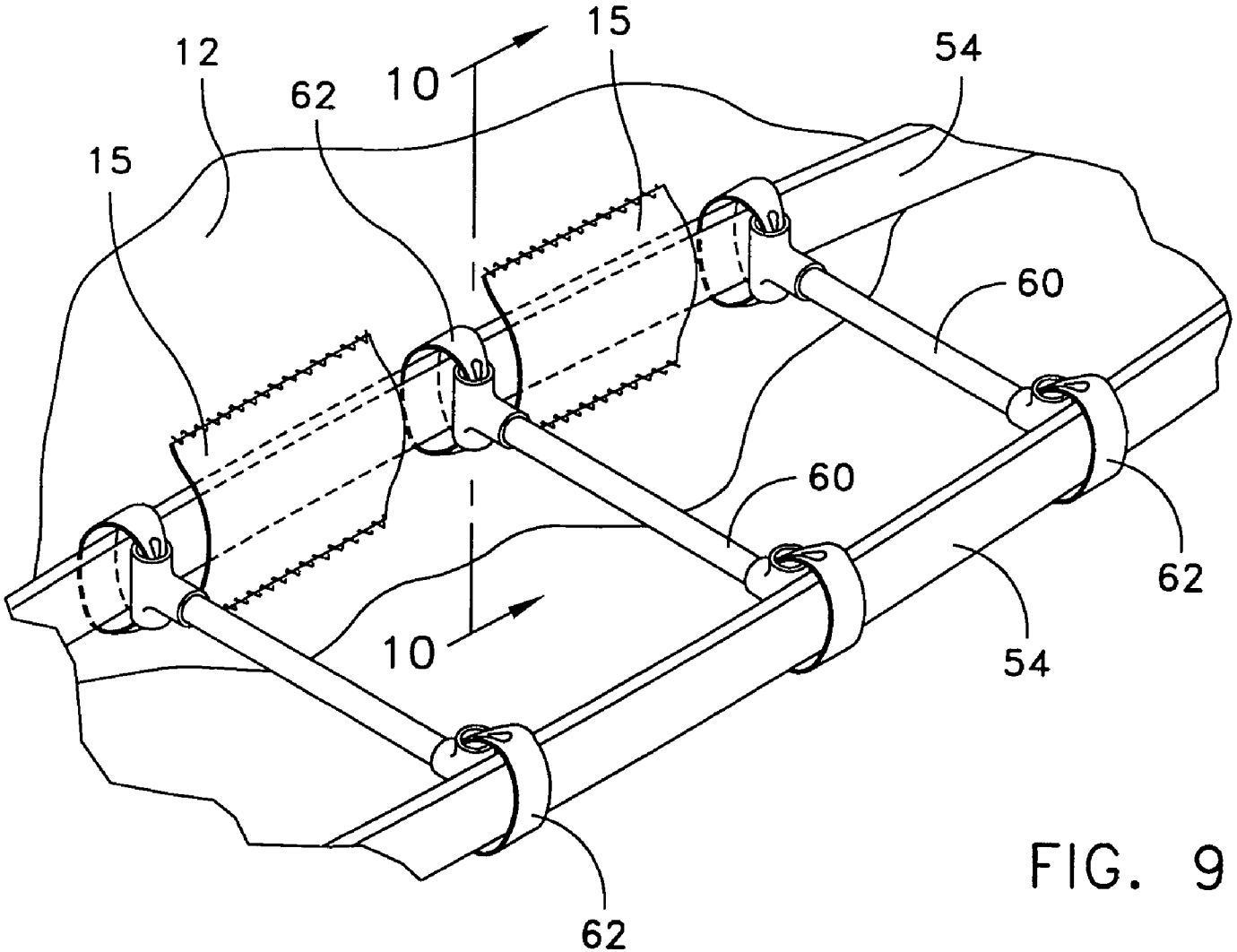
FIG. 9 is a fragmentary perspective view of the alternate embodiment of the sail apparatus also showing the attachment with the sail cloth.
Figure 10:
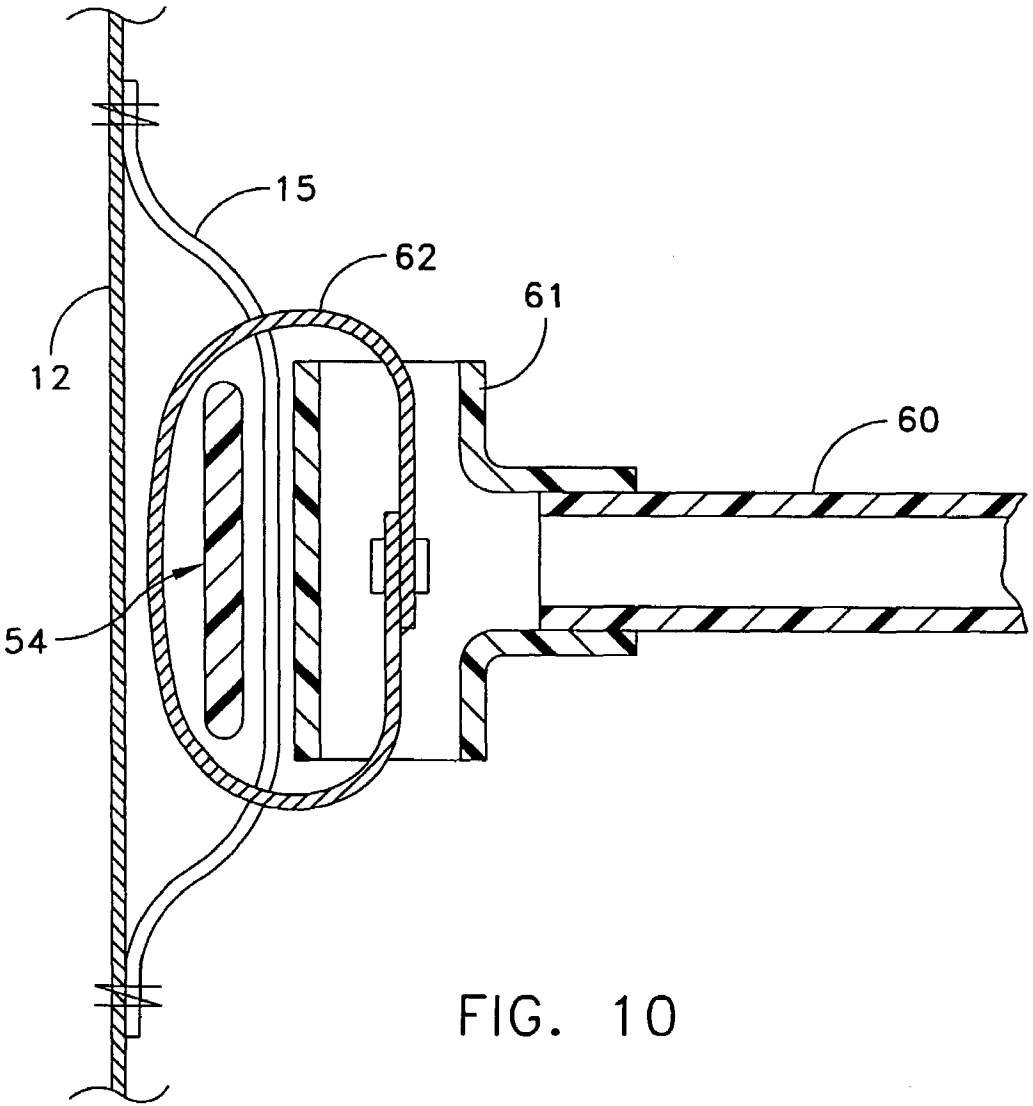
FIG. 10 is a cross-sectional view taken along line 10-10 of FIG. 9.

The first embodiment of the foil structure is illustrated in FIGS. 1-7. Fragmentary views of a second embodiment are depicted in FIGS. 8-10.

In the first embodiment the three-dimensional sail apparatus foil 20 is comprised of elongated rails 24 that may be constructed of a lightweight wood or a lightweight metal material. These rails 24 terminate at respective ends at end members 25 and 26. The end member 25 is provided with a hole 27 for engaging with the mast 14. Each of the foils 20 is appropriately supported at space locations along the mast 14 such as schematically illustrated in FIG. 1.

The three-dimensional sail apparatus foil 20 also includes a plurality of spreaders 30 that in this embodiment are each of a triangular shape and extend between respective rails 24. Each of the spreaders 30 is held between the respective rails 24 by means of loops 32. The cross-sectional view of FIG. 7 illustrates one of the loops 32 secured to a spreader 30 by means of fasteners 35. In accordance with the present invention various types of fasteners may be used. Each of the loops 32 functions as a sliding member that enables limited sliding of the spreaders 30 along rails 24. As illustrated in FIG. 6, the sail cloth 12 is preferably provided with tabs 15 between each spreader so as to limit the extent that the spreader can transition along the rails. Because each of the spreaders in this embodiment is illustrated as a triangular shape, there is one loop 32 on one side thereof and a pair of loops 32 on the opposite side thereof. These triangular members alternate in the manner illustrated in, for example, FIG. 3. FIG. 7 shows each of the tabs 15 as stitched at 17 to the sail cloth 12.

Figure 3:
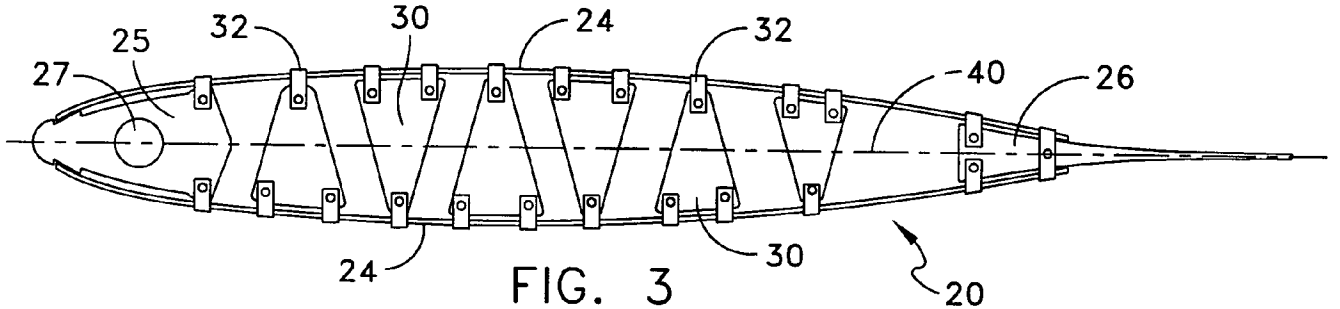
FIGS. 3-5 illustrate different positions of the foil of FIG. 2 including a neutral position and respective alternating wind direction positions.
Figure 4:
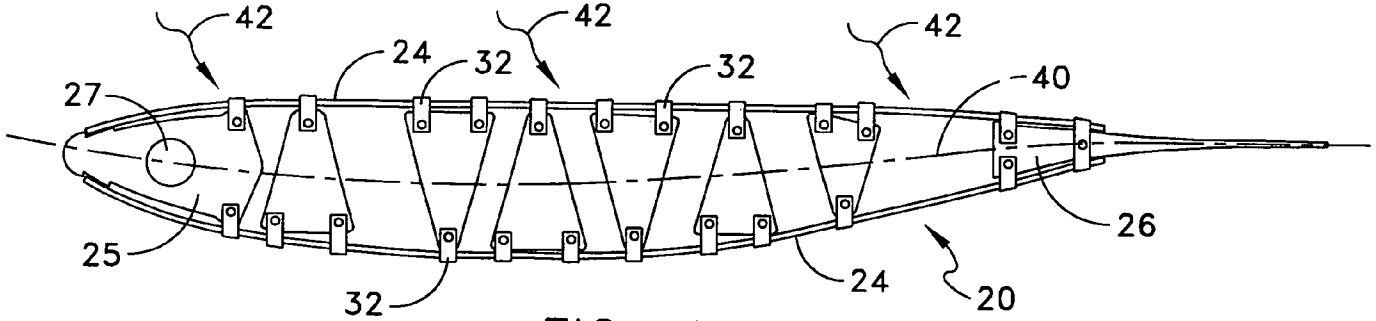
Figure 5:
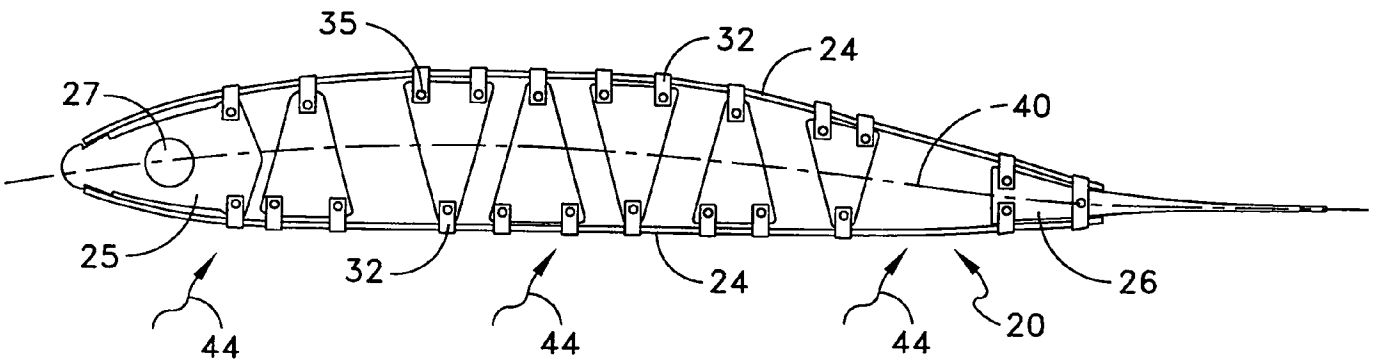

Reference is now made to FIGS. 3-5 which may be considered as plan views of the foil 20 in the various positions. These positions are depicted with relationship to a center line 40. FIG. 3 depicts the foil 20 in what may be termed a neutral position. In that position it is noted that the center line 40 is basically a straight line extending between the end members 25 and 26. The purpose of the illustrations in FIGS. 3-5 is to indicate the manner in which the foil reverses depending upon the wind direction, from one asymmetric shape to a reversed asymmetric shape.

FIGS. 4 and 5 depict the manner in which the foil is deflected depending upon the wind direction. In FIG. 4 the wind direction is indicated by the arrows 42 from above. Alternatively, FIG. 5 depicts the opposite wind direction by the arrows 44 from below. It can be seen from the view of FIG. 4 that with the wind direction indicated by the arrows 42, that the top rail 24 becomes more linear or flattened and the bottom rail 24 becomes more bowed than that shown in FIG. 3. This causes the center line 40 to dip. Similarly, in the view of FIG. 5 the bottom rail 24 becomes more linear or flattened and the top rail 24 becomes more bowed with the center line 40 being now arced upwardly.

Thus, the foil of the present invention has the ability to deflect in opposite directions depending upon the wind direction that the sail faces. There is actually a deformation of the foil between the possible positions shown in respective FIGS. 4 and 5. This greatly enhances the ability to be able to "tack" with the sail apparatus of the present invention. During the movement such as between the positions shown in FIGS. 4 and 5, it is noted that the spreaders 30 have the capability of moving slightly along the rail at the support loops 32 so as to readjust to the different positions illustrated. Again, as illustrated in FIGS. 6 and 7, the sail cloth 12 is attached by means of tabs 15 to the rails 24. Of course, there is a sail cloth on either side of the rails 24, only one of which is depicted in FIG. 6. With the use of these tabs, this assists in maintaining a space relationship between the spreaders while at the same time allowing some limited sliding of the spreaders as may be necessary in deflecting or deforming between positions. It is also to be noted that this action between these positions occurs virtually automatically depending upon the wind direction. The foil is not re-shaped manually but simply re-shapes itself, again depending upon the wind direction.

Reference is now made to a second embodiment of the present invention illustrated in FIGS. 8-10. FIGS. 8 and 9 show only fragmentary portions of the foil, it being understood that a series of spreaders are used in a similar manner to that shown in FIG. 2. The embodiment shown in FIGS. 8-10 includes rails 54. Each of these rails may have a substantially rectangular cross-section and may be constructed of a lightweight plastic material. In the embodiment shown in FIGS. 8-10 there is illustrated a series of spreaders 60. Each of the spreaders 60 includes a rod-like member supporting at each end thereof a loop 62 that extends about each respective rail 54.

FIG. 9 also illustrates the manner in which the sail cloth 12 is attached with its associated tabs 15 for somewhat controlling the movement of the spreaders 60 along the rails. Each of the loops 62 is sufficiently loose on the rails so as to permit at least limited sliding thereof along the rail. The cross-sectional view of FIG. 10 illustrates further details of the spreader 60 with its end post 61 through which the loop 62 extends. The loop 62 may be secured in an appropriate manner within the end post 61 and is shown extending through the post 61 and about the rail 54.

In this second embodiment each of the spreaders 60 may be of different lengths depending upon their closeness to the end members. The closer to the end members the shorter the spreaders may be. The number of spreaders used is usually a function of the length of the foil which can vary from vessel to vessel. The spreaders 60 are preferably constructed of a plastic material and the illustrated ones have a circular cross-section. In both embodiments described herein the spreaders are preferably somewhat loosely attached at the rails so that it is possible to provide the deformation, as illustrated in FIGS. 3-5. This free attachment is also characterized by the ability of the spreaders to have some limited linear movement relative to the supporting rails.

It will be understood that various modifications may be made to the embodiments disclosed herein. For example, it should be understood that a variety of materials may be utilized for both the rails and the spreaders. Also, other forms and shapes of spreaders may be used between the rails. Therefore, the above description should not be construed as limiting, but merely as exemplifications of preferred embodiments. Those skilled in the art will envision other modifications within the scope, spirit and intent of the invention.

What is claimed is:

1. A three-dimensional sail apparatus comprising:
a plurality of foils supported from a mast;
a sail cloth for attachment to the foils on opposite sides thereof;
each said foil including;
a pair of rails that together form the foil shape,
the pair of rails each having opposed ends,
a pair of end members,
means for fixedly securing the respective end members to the opposed ends of the pair of rails,
a plurality of spreaders that are spacedly disposed along the rails, each extending between the respective rails of the pair of rails and each including opposed ends, and
a plurality of sliding connections that support the spreaders on the rails,
said plurality of sliding connections including at least one sliding connection for slideably supporting each end of the spreader.

2. The three-dimensional sail apparatus of claim 1 wherein the sail cloth has spaced sleeves for attachment to each foil.

3. The three-dimensional sail apparatus of claim 1 wherein said pair of end members include a fore end member and an aft end member, and the fore end member has a hole therein for receiving the mast.

4. The three-dimensional sail apparatus of claim 1 wherein each sliding connection comprises a closed loop with each loop extending about the rail while enabling a limited sliding of the loop along the rail.

5. The three-dimensional sail apparatus of claim 1 wherein each spreader includes a cross bar and each sliding connection includes a hollow post supported by the cross bar and forming a loop extending about the rail.

6. The three-dimensional sail apparatus of claim 1 wherein each sliding connection includes a loop that connects from the spreader about the rail.

7. The three-dimensional sail apparatus of claim 1 wherein each rail has a rectangular cross-section.

8. A three-dimensional sail apparatus comprising:
a plurality of foils supported from a mast;
a sail cloth for attachment to the foils on opposite sides thereof;
each said foil including;
a pair of rails that together form a foil shape,
a plurality of spreaders that are spacedly disposed between the pair of rails, and
a plurality of sliding connections that support the spreaders on the rails;
wherein each spreader has opposite ends that are slideably supported on respective rails
wherein each spreader has a triangular shape and is supported by one sliding connection to one of the rails and by two sliding connections to the other of the rails.

9. A sail foil for supporting sail cloth and comprising:
a pair of rails that together form a foil shape and each rail having ends that are fixed with respect to ends of the other rail;
a plurality of spreaders that are each disposed between the pair of rails with adjacent spreaders maintained in spaced relationship; and
a plurality of sliding connections that support the spreaders on the rails with each spreader having at least one sliding connection coupled with each rail;
each said sliding connection comprising a closed loop member that extends about the rail for slideably supporting each end of the spreader on and along the rail;
a pair of end members and means for fixedly securing the respective end members to opposed ends of the pair of rails, and wherein one of said end members has a hole therein for receiving a mast.

10. The sail foil of claim 9 wherein each spreader comprises a tubular member.

11. The sail foil of claim 9 wherein each spreader includes a cross bar and each sliding connection includes a hollow post supported by the cross bar and forming a loop extending about the rail.

12. A sail foil for supporting sail cloth and comprising:
a pair of rails that together form a foil shape;
a plurality of spreaders that are each disposed between the pair of rails with adjacent spreaders maintained in spaced relationship; and
a plurality of sliding connections that support the spreaders on the rails with each spreader having at least one sliding connection coupled with each rail;
wherein each spreader has a triangular shape and is supported by one sliding connection to one of the rails and by two sliding connections to the other of the rails.

13. A three-dimensional sail apparatus that is comprised of a plurality of spacedly disposed foils and a sail cloth for attachment to the foils on opposite sides thereof, each said foil having opposed sail cloth supporting sides that together define a foil shape and a pair of support rails each having opposed ends, a plurality of spreaders between said sides for controlling the relative positioning between the sides of the foil, each rail adapted to deflect under wind force against the sail cloth so that said foil can assume opposite respective asymmetric foil shapes, means for providing a plurality of sliding loops between the respective rails and the spreaders, each said sliding loop comprising a closed loop member that extends about the rail for slideably supporting each end of each spreader on and along the rail, and means for fixedly attaching together opposed ends of respective rails.

14. The three-dimensional sail apparatus of claim 13 wherein each spreader support comprises a tubular member.

15. The three-dimensional sail apparatus of claim 14 wherein each tubular member has opposite end posts for receiving the closed loop member.

16. A three-dimensional sail apparatus that is comprised of a plurality of spacedly disposed foils and a sail cloth for attachment to the foils on opposite sides thereof, each said foil having opposed sail cloth supporting sides that together define a foil shape, a support between said sides for controlling the relative positioning between the sides of the foil, each rail adapted to deflect under wind force against the sail cloth so that said foil can assume opposite respective asymmetric foil shapes;

wherein said support includes a plurality of spreaders that are spacedly disposed between the pair of rails, and a plurality of sliding connections that support the spreaders from the rails wherein each spreader comprises a triangular member having one attachment point at one side thereof and a pair of attachment points at the other side thereof.

* * * * *